United States Patent [19]

Desarno

[11] 4,300,582

[45] Nov. 17, 1981

[54] STORM UMBRELLA

[76] Inventor: James G. Desarno, 420 Buttermere Ave., Interlaken, N.J. 07712

[21] Appl. No.: 97,319

[22] Filed: Nov. 26, 1979

[51] Int. Cl.[3] ..... A45B 25/22

[52] U.S. Cl. ..... 135/20 R; 135/27; 135/35 V

[58] Field of Search ..... 135/20, 16, 25, 27, 135/31, 35 V, 33

[56] References Cited

U.S. PATENT DOCUMENTS

| | | | |
|---|---|---|---|
| 122,453 | 1/1872 | Gossip | 135/27 |
| 597,717 | 1/1898 | Illoway | 135/27 |
| 2,561,435 | 7/1951 | Woodward | 135/31 |
| 3,032,047 | 5/1962 | Wendorf | 135/35 V |
| 3,930,514 | 1/1976 | Wu | 135/27 |

FOREIGN PATENT DOCUMENTS

| | | | |
|---|---|---|---|
| 1551528 | 8/1979 | United Kingdom | 135/35 V |

*Primary Examiner*—J. Karl Bell

*Attorney, Agent, or Firm*—Charles F. Gunderson

[57] ABSTRACT

A reenforcing annular ring is provided along the outer edge of the inside of the canopy of an umbrella. The reenforcing ring is made of a flexible, cloth-like material with its outer portion fastened to the panels of the canopy. The inner portion of the reenforcing ring is fastened to a ring of strong flexible rope that secures the reenforcing ring and the panels of the canopy against outward flexing in a high wind.

6 Claims, 3 Drawing Figures

STORM UMBRELLA

BACKGROUND OF THE INVENTION

There are very many types of umbrellas, but by far the most common is the folding type with a canopy of sections of water-proof material stretched over ribs hinged to a center pole and opened by a series of corresponding intermediate ribs secured to a sliding cylinder, whose motion up and down the center pole causes the outer ribs to be opened or closed. Umbrellas may also be adapted for other functions such as walking sticks or package carriers.

Since the canopies must be flexible material, and must cover a substantial area to be at all effective, and since the ribs must be light to provide an umbrella that can be carried without too much difficulty, and flexible to extend the fabric of the canopy, the umbrella becomes very vulnerable to wind. The sight of umbrellas blown inside out in a storm is all too common on a windy day, and the umbrella is usually ruined by such a happening.

Many attempts have been made to reenforce umbrellas. Wendorf, as a typical example, teaches a Storm Umbrella in his U.S. Pat. No. 3,032,047, of May 1, 1962. The reenforcing includes a peripheral cord secured to each of the ends of the outer ribs, as well as a series of guy assemblies, also attached to the ends of the outer ribs, and connected to a sleeve on the center pole.

This will apparently keep the ends of the ribs from being drawn outwardly to turn the umbrella inside out in the usual manner, but the material of the canopy itself is still free to billow outwardly, and, even with the air vents in the canopy, the canopy might be drawn upwards to some extent.

It is therefore an object of this invention to provide an improved storm-proof umbrella. It is a further object of this invention to provide an improved storm-proof umbrella wherein the canopy as well as the ribs are secured in such a manner that they cannot be drawn upwardly or outwardly.

SUMMARY OF THE INVENTION

These objects are achieved by attaching an annular ring of flexible material around the periphery of the bottom, outer portion of the canopy between the ribs. The inner portion of the annular ring of flexible material is secured to a continuous cord of flexible, but not stretchable material. The outer portion of the ring of flexible material secures the fabric of the canopy as well as the ends of the ribs, and, with the strength of the inner cord, holds the entire structure against turnout or damage even in quite extreme conditions.

DESCRIPTION OF THE PREFERRED EMBODIMENT

Figure 1:
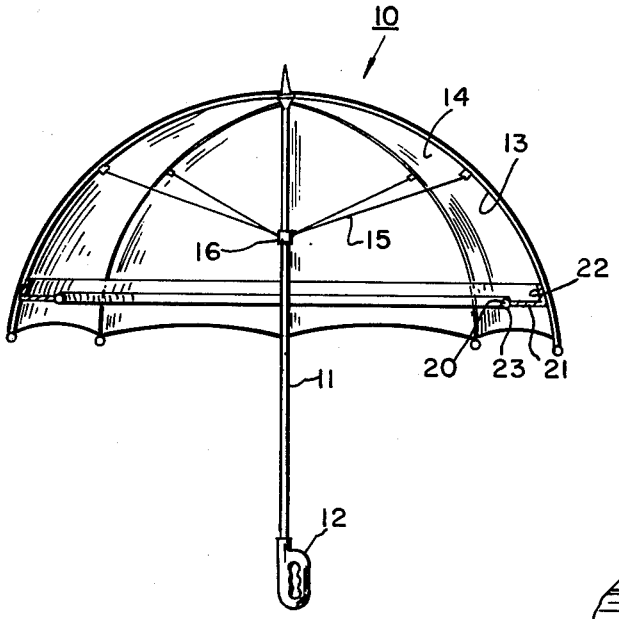
FIG. 1 shows a side view, partly in cross section of the umbrella.

Referring now more particularly to FIG. 1, a side view of an open umbrella 10 is shown, partly in cross section, with a center pole 11 having a handle 12. Outer ribs 13 extend radially from the top of the center pole, and are held away from the center pole by the intermediate ribs 15 to provide a frame-work for the canopy 14.

The intermediate ribs are supported and controlled by the sliding cylinder 16.

In this invention, an annular ring of flexible material 21 has a rope 20 secured to the inner portion of the material by fastenings or bondings such as 23. The outer portion of the ring material is secured to the canopy 14 and ribs 13 by fastenings or bondings such as 22.

Figure 2:
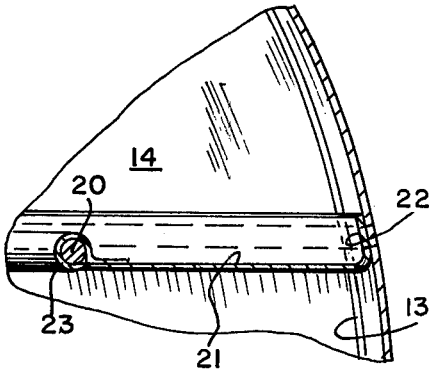
FIG. 2 shows an enlarged view, also in cross section, of a portion of FIG. 1.

FIG. 2 shows this more clearly as an enlarged cross section of a portion of FIG. 1 that includes the ring of material 21, the rope 20, and the fastenings 22 and 23. Similar elements in FIGS. 1 and 2 are similarly numbered.

Figure 3:
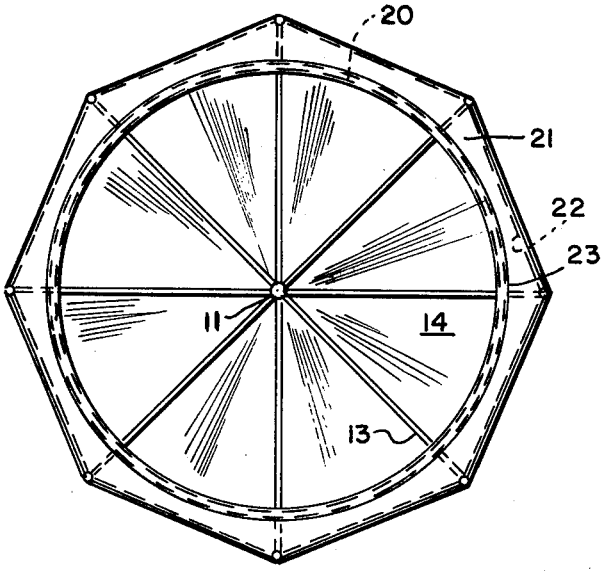
FIG. 3 shows a bottom view of the umbrella.

FIG. 3 is a view of the umbrella of FIG. 1 from underneath, and has the same elements similarly numbered. This view shows a typical position and shape for the annular ring 21 and for the binding 22 to each sector of the canopy 14 between the ribs 13. The handle 12 has been omitted for clarity.

In practice, the center pole and handle of this device are conventional; as are the outer and intermediate ribs 13 and 15, and the sections of canopy 14. The sliding cylinder 16 is shown in its upward position to urge the intermediate ribs against the outer ribs to hold the canopy in an open, rain-shedding position. Suitable latches would be provided, in a well known manner, to hold the sliding cylinder in this open position as well as in a lower, closed position of the umbrella.

In this invention, an annular ring of flexible material 21 is added. The outer portion of this material is secured to the panels of the canopy and ribs at 22, and the inner portion of the material is secured to a rope 20 along 23. This ring of material would normally have straight sections along its outer portion to conform with the sections of canopy stretched flat between the ribs 13.

The annular ring 21 could be cut from a whole piece of cloth or other material, but it may be better to cut it in segments corresponding to the segments of the canopy. This would provide more accurate alignment and easier sewing, besides being able to have the weave of the cloth aligned between the canopy and the rope for maximum strength and consistency. The inner portion of the ring would normally be circular to provide uniform tension in the rope, and may be sewn along 23 to form a sleeve for the rope 20.

The ring may be of any flexible cloth or the like that can be securely fastened to the canopy as well as the rope. It may also be of a reenforced plastic or a netting, since it need not be waterproof.

The outer portion of the material of the ring may be sewn to the sections of the canopy, or it may be glued or fastened in other well known ways. The junction between the reenforcing panel and the panels of the canopy would be as close to the outer edges of the panels as practical. The inner rope supports the annular ring of material which must have some degree of resiliency and may have some degree of stretch. The rope must have a reasonable tensile strength and resist stretching, but it must be pliant and should not be too bulky. The rope may be pre-formed to a prescribed length before it is fastened to the material of the ring, or it may be adjusted through a convenient opening when the umbrella is opened.

The handle may be conventional, but a stronger handle, with a more positive grip, as shown here, is suggested because of the excessive pressures that may be anticipated.

Proportionate sizes are illustrated for practical embodiments of this invention, but specific sizes would vary with the size of the umbrella, the wind forces anticipated, and the bulk that is tolerable.

The width of the ring of material may be only enough to provide secure fastening to the panels of the canopy and to the rope, or it may extend well in toward the center pole. This latter might be more cumbersome, but might provide improved baffling effects in higher winds.

It is to be understood that I do not desire to be limited to the exact details of construction shown and described since obvious modifications will occur to a person skilled in the art.

What is claimed is:

1. In combination with an umbrella having a center pole, a handle, a plurality of hinged radial outer ribs, and a plurality of sections of waterproof material extending between said outer ribs to form a canopy; an annular ring of flexible material; means for fastening the outer portion of said ring of flexible material continuously along the inside of the lower portions of said sections of waterproof material forming said canopy to secure said lower portions of said canopy sections and of said ribs to said ring of flexible material; a continuous ring of rope; and means for fastening said rope along the inner portion of said ring of flexible material to prevent its expanding outwardly.

2. An umbrella as in claim 1 wherein said annular ring of flexible material is secured in a plane perpendicular to the axis of the center pole.

3. An umbrella as in claim 1 wherein said continuous ring of rope is flexible and forms a ring concentric with said center pole.

4. An umbrella as in claim 1 wherein said continuous ring of rope is a multi-strand wire rope.

5. An umbrella as in claim 1 wherein said ring of flexible material is secured to said sections of waterproof material in a straight line between said radial outer ribs.

6. An umbrella as in claim 1 wherein said ring of flexible material is formed of a series of sections, each corresponding to and fastened to a corresponding one of said sections of waterproof material.

* * * * *